US005649837A

United States Patent [19]

Arnold

[11] Patent Number: 5,649,837

[45] Date of Patent: Jul. 22, 1997

[54] MODULAR CONNECTION DEVICE WITH LARGE CLEARANCE

[75] Inventor: Claude Arnold, Strasbourg, France

[73] Assignee: Constructions Electriques Fels (Societe Anonyme), Illkirch Graffenstaden, France

[21] Appl. No.: 523,251

[22] Filed: Sep. 5, 1995

[51] Int. Cl.[6] ..... H01R 13/73

[52] U.S. Cl. ..... 439/557; 439/851; 439/247; 439/843; 439/845

[58] Field of Search ..... 439/557, 851, 439/884, 378, 379, 271, 82, 751, 930, 247, 248, 843, 845

[56] References Cited

U.S. PATENT DOCUMENTS

| | | | |
|---|---|---|---|
| 1,552,262 | 9/1925 | Betz | 439/732 |
| 4,900,278 | 2/1990 | Yamada et al. | 439/884 |
| 5,106,310 | 4/1992 | Krajewski et al. | 439/751 |

FOREIGN PATENT DOCUMENTS

| | | | |
|---|---|---|---|
| 0147828 | 8/1985 | European Pat. Off. . | |
| 2127328 | 10/1972 | France . | |
| 2491716 | 4/1982 | France . | |
| 368101 | 1/1923 | Germany . | |
| 1465765 | 4/1969 | Germany . | |
| 2512152 | 10/1976 | Germany . | |
| 3214574 | 9/1991 | Japan | 439/930 |

*Primary Examiner*—Neil Abrams
*Assistant Examiner*—T. C. Patel
*Attorney, Agent, or Firm*—Young & Thompson

[57] ABSTRACT

A connection device that is modular and has large clearance and that is constituted by two insulating casings (1 and 2) installed through a partition, a first casing (1) being mounted on a movable partition (3) and the other casing (2) being mounted on a fixed partition (4). The first casing (1) has at least one conductive pin (5) and the second casing (2) has at least one contact receptacle (6) of a shape corresponding to that of the conductive pin (5). The conductive pin (5) and the contact receptacle (6) are mounted on the partitions (3 and 4) only for limited elastically opposed pivotal movement relative to the partitions (3 and 4).

11 Claims, 3 Drawing Sheets

MODULAR CONNECTION DEVICE WITH LARGE CLEARANCE

FIELD OF THE INVENTION

The present invention relates to the field of electrical installations, particularly electrical cabinets comprising sliding pin connectors and has for its object a modular connection device with large clearance.

BACKGROUND OF THE INVENTION

There exists at present a requirement as to the connection of the auxiliaries in slide pin electrical panels, which is not satisfied by existing products. Thus, the known materials are a source of difficulty, in particular given the clearances of the slides and require the emplacement of auxiliary mechanisms. Moreover, the known connectors do not have sufficient flexibility as to the number of poles that can be provided.

It is to be remembered that in the field of connection by pins by means of slides, different conditions are to be taken into consideration, namely, a disengaged slide position, a partially engaged slide position and a fully engaged slide position. In the first position the connection is interrupted, whilst in the second position the control circuits are supplied, the final engagement position corresponding to the establishment of power circuits.

The use of slides for connection gives rise to faults of alignment which can vary between plus or minus 3 mm.

At present, the connection of the control circuits of the sliding pin connections is effected, either by means of one or several standard multi-pin connectors, or by means of one or several special connectors with slide contacts.

The multi-pin connectors, however, have the drawback of a short path of movement, often less than 10 mm, such that they require the use of mechanical devices for facilitating movements.

Moreover, their inability to tolerate errors of alignment between the male and female parts requires the use of re-centering means.

Finally, the connectors have an invariable mechanical size, no matter what the number of pins in use.

The special connectors with slide contact do not permit guaranteeing more than one point contact in the case of misalignment. Moreover, these connectors also have, as do the multi-pin connectors, an invariable mechanical size.

SUMMARY OF THE INVENTION

The present invention has for its object to overcome these drawbacks.

It thus has, as an object, a connection device characterized in that it is modular and has large clearance and in that it is constituted by two insulating casings installed through a partition, a movable one being mounted on a movable element and the other fixed one being mounted on a fixed element, the movable casing carrying at least one conductive pin and the fixed casing being provided with at least one contact receptacle of a shape corresponding to that of the conductive pin.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE PREFERRED EMBODIMENTS

Figure 1:
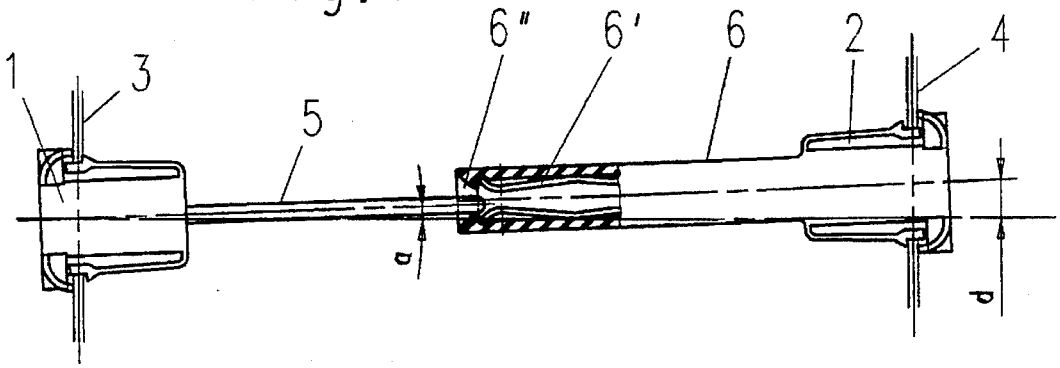
FIG. 1 is a side elevational view partly in cross section of the device according to the invention.

According to the invention and as shown more particularly by way of example in FIG. 1 of the accompanying drawings, the connection device is modular and has a large clearance and is constituted by two insulating casings 1 and 2 installed through a partition, a movable casing 1 being mounted on the movable element 3 and the other fixed casing 2 being mounted on a fixed element 4, the movable casing having at least one conductive pin 5 and the fixed casing 2 being provided with at least one contact receptacle 6 of a shape corresponding to that of the conductive pin 5.

The movable casing 1, also called the movable connector, is mounted on a slide forming the movable element 3, whilst the fixed casing 2, also called a fixed connector, is mounted on the rear of a panel forming the fixed element 4.

Figure 8:
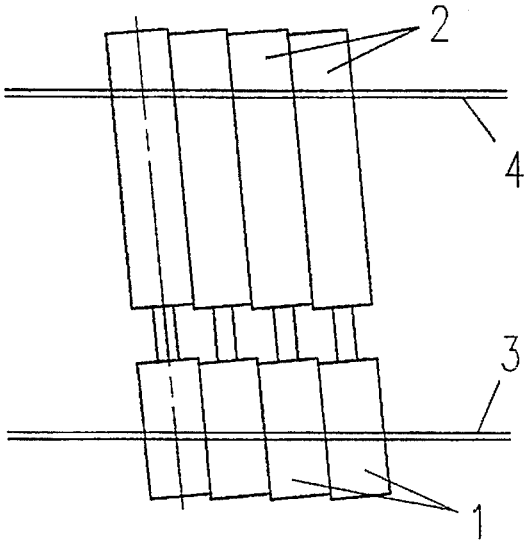
FIG. 8 shows in plan view the mounting of several devices according to the invention, in offset position.

As shown more particularly in FIG. 8, several modular elements according to the invention can be juxtaposed, so as to constitute the necessary number of poles.

Figure 2:
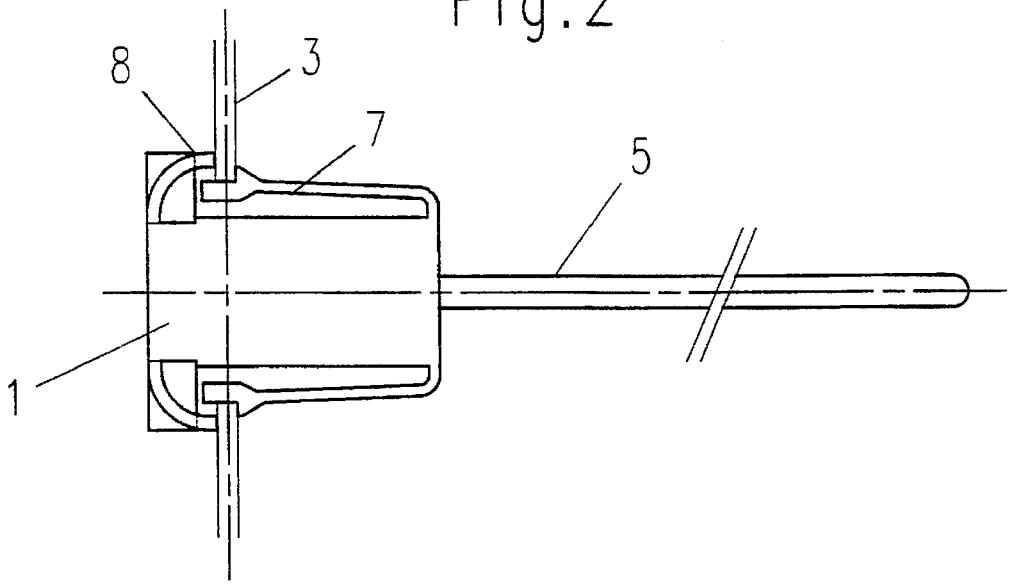
FIG. 2 is a view analogous to that of FIG. 1, on a larger scale, of only the movable casing.

The casings 1 and 2 are preferably in a known manner of plastic material and are provided as shown more particularly in FIGS. 1 and 2, on the one hand, with at least two elastically deformable opposed clips 7 for application against the internal surfaces of the movable element 3 and of the rear of the fixed element 4 and, on the other hand, with independent elastic fingers 8, preferably four fingers 8, disposed in opposition to the clips 7 and having a spring function for the locking of the casings 1 and 2 in the service position. Thus, the fingers 8 maintain, because of the pressure that they exert, the casing 1 or 2 in a position perpendicular to the partition of the movable element 3 or fixed element 4. This pressure is determined in a known manner so as to permit the pivoting of the casing about one of the bearing points, as soon as a force is exerted at the end of the pin 5 or of the receptacle 6, the casing returning then to the initial position as soon as the force is relieved.

Figure 6:
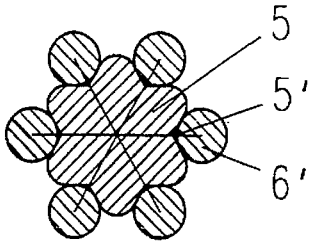
FIGS. 5 and 6 are views in transverse cross section, on a larger scale, of two embodiments of the device in the pin-engaged position, at the level of the contact between the pin and the receptacle of the fixed casing.
Figure 5:
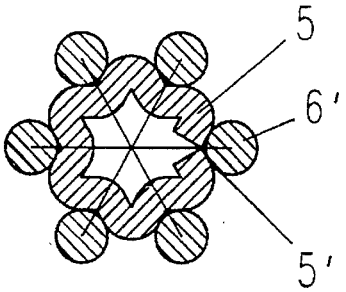

According to one characteristic of the invention, the conductive pin 5 has in transverse cross section notches 5', spaced uniformly about its periphery (FIGS. 5 and 6) and, at its free end, a rounded or conical end (FIGS. 1, 2, 9 and 10).

This conductive pin 5 can be produced by stamping and rolling a conductive sheet metal (FIG. 5), or from an extruded profile, or else from a drawn wire (FIG. 6) and it is secured in the movable casing 1.

The provision of a rounded or conical end at the free end of the pin 5 is adapted to facilitate the engagement of said pin 5 in the receptacle 6 of the fixed connector module or fixed element 4.

The contact receptacle 6 is constituted preferably by contact fingers 6' extending concentrically about the axis of penetration of the pin 5 and of a number equal to that of the notches 5' of said pin 5 and coacting with these latter in service position.

Moreover, the contact receptacle 6 is provided on the side opposite the fixed casing 2, with an entry cone 6" narrowing toward the contact fingers 6'. Such an entry cone is adapted to facilitate the penetration of the pin 5 into the receptacle 6, even in the presence of misalignment caused by an offset d (FIG. 1). This entry cone 6" has a small cross section less than that determined by the ends of the fingers 6' forming the receptacle 6 at the level of the cone 6".

Figure 3:
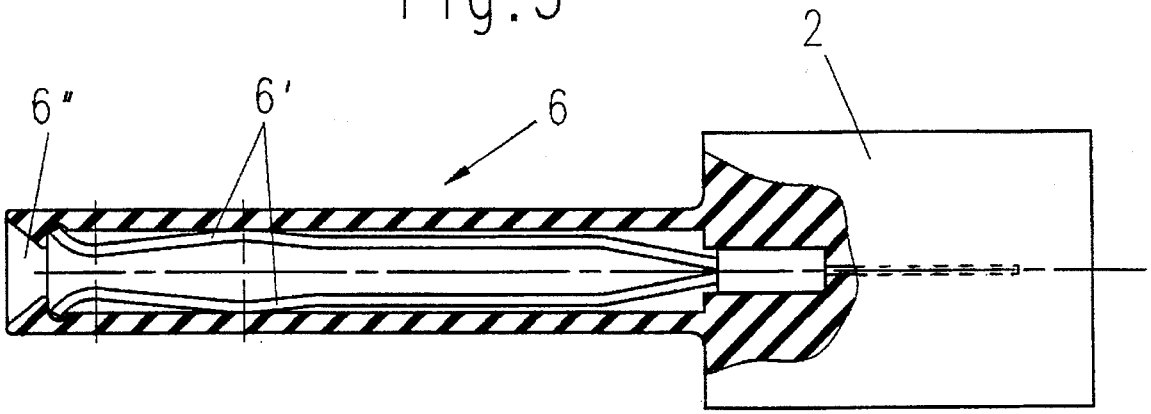
FIG. 3 is a side elevational view partly in section, on a larger scale, of only the fixed casing.

The contact fingers 6' are fixed in the body of the fixed casing 4 by gripping over a single connection length (not shown) and are made from wires of conductive spring material. So as to ensure the passage and the sliding of the pin 5, the contact fingers 6' each have the shape of a crook (FIG. 3). Thus, during engagement of the pin 5 between the fingers 6', they exert a reactive force on said pin 5 via each finger 6' pressed against the bottom of the corresponding notch 5' under the effect of the spring force due to the deformation of the crook of said fingers 6'. As a result, the contact between each finger 6' and its groove 5' is established at two points over all the length of the path of the pin 5 and at an angle of maximum clearance in all planes. This angle is determined approximately by the relationship:

$$tg\ a = \frac{\text{height of the crook}}{\text{length of penetration of the pin}}$$

The mounting of the contact fingers 6' over a single connection length permits controlling their orientation relative to the position of the notches 5' of the pin 5.

Figure 4:
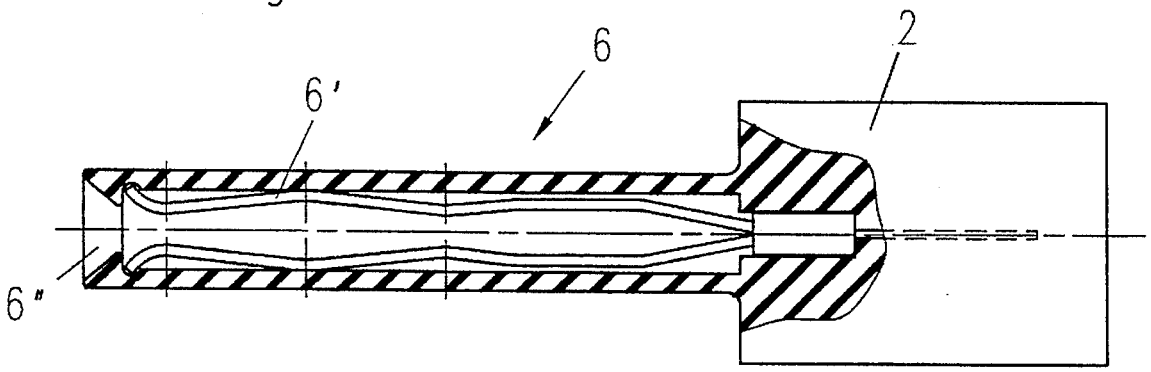
FIG. 4 is a view similar to that of FIG. 3 of a modified embodiment of contact receptacle in the fixed casing.

FIG. 4 of the accompanying drawings shows a modified embodiment of the receptacle 6, in which the contact fingers 6' have several undulations. Thus, it is possible to multiply the number of contact points between each finger 6' and the notch 5' corresponding to the path of penetration of the pin, such that the total electrical resistance is progressively reduced. Moreover, in such a case, the friction of the first undulation of each finger 6' on the pin 5 ensures, during engagement of said pin 5, the cleaning of the contact surfaces of the pin for the following undulations.

Figure 7:
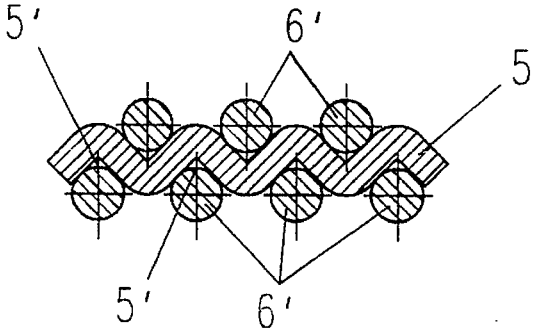
FIG. 7 is a fragmentary transverse cross-sectional view on a larger scale of a modified embodiment of the pin and of the receptacle of the fixed casing.

FIG. 7 of the accompanying drawings shows a modified embodiment of the device, in which the conductive pin 5 has a substantially flat alternately longitudinally notched cross section from one face to the other and coacts with contact fingers 6' extending alternately offset in two parallel planes, at a mutual distance from one plane to the other that is equal to the wall thickness of the pin 5. Such a pin 5 can for example be formed by stamping.

Thanks to the provision of the independent resilient fingers 8 and clips 7 (FIG. 2) for the securement and positioning of the movable and fixed casings 1 and 2, faults of alignment between said casings 1 and 2 carrying the pin 5 and the contact receptacle 6 can be compensated. Thus, each casing being installed through a partition on a plate whose thickness corresponds substantially to the spacing between the securement hook of the clips 7 and the corresponding surface of the fingers 8, the holding of the casings 1 and 2 is ensured with the possibility of angular pivoting. The casings 1 and 2 are mounted in a window of the plate of the movable and fixed elements 3 and 4, of which one of the dimensions corresponds to the predetermined dimension between the hooks of the clips 7, whilst the other dimension corresponds to a multiple of the other dimension of the casings 1 and 2. Such a window is therefore cut out as a function of the number of modules according to the invention to be emplaced. The mounting plates of the casings 1 and 2 are an integral part of the movable element 3 or slide, or of the fixed element 4 or panel back. FIG. 8 of the accompanying drawings shows a mounting of several modular devices according to the invention with a slight offset relative to the movable and fixed elements 3 and 4. Because of the juxtaposition of these elements, the inclination of one of them requires a corresponding inclination of the other.

During insertion of the pins between a movable connector 1 and a fixed connector 2 having misalignment, as shown by way of example in FIG. 1 of the accompanying drawings by the offset d, the end of the pin 5 of the movable connector 1 is guided by the entry cone 6" formed on the end of the contact receptacle 6 of the fixed connector 2. The arrival into contact of the pin 5 and the receptacle 6 is effected with application of mutual force giving rise to corresponding pivoting of the casings 1 and 2 about and on their bearings giving rise to an alignment of these latter, as shown in FIG. 8 of the accompanying drawings.

The entry cone 6" provided on the contact receptacle 6 is preferably so dimensioned as to avoid any involuntary contact with the electrified members in the separated pin mode and integrates the constraints imposed by standard tests of the test finger and of the ball.

Figure 9:
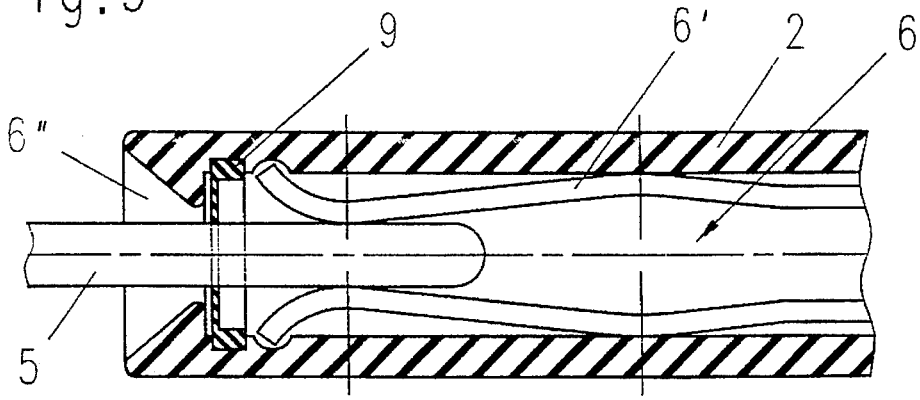
FIG. 9 is a fragmentary cross-sectional view of another modified embodiment of the invention.

FIG. 9 of the accompanying drawings shows a modified embodiment of the invention, in which the fixed casing 2 for holding the contact receptacle 6 is provided, between the entry cone 6" and the end of the contact fingers 6', with a sealing ring 9 having an internal cross section corresponding to that of the corresponding pin 5 and preferably made of a flexible plastic material. Thus, it is possible to ensure sealing from dust and ambient air of the established contact.

This ring 9 matches closely the profile of the pin 5 whilst applying a slight resilient pressure and ensures because of this a cleaning function during engagement of the pin 5 and the sealing of the receptacle 6 during all the movement of the pin 5.

Figure 10:
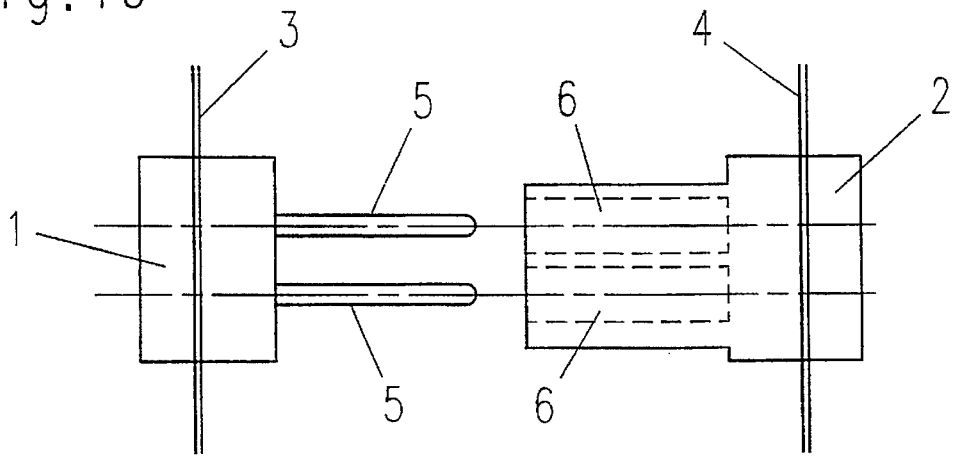
FIG. 10 is a side elevational view of a device with two poles.

Finally, FIG. 10 shows another modified embodiment of the invention, in which each casing 1 and 2 comprises at least two pins 5 or receptacles 6. Such an embodiment permits, whilst conserving the modularity and small size, ensuring at least one bipolar junction.

Thanks to the invention, it is possible to provide a modular connection device permitting large clearance, such that alignment faults can easily be overcome. Moreover, it is possible to ensure optimum contact in the two positions of depth of insertion of the pin, no matter what the offset.

Of course, the invention is not limited to the embodiment shown and described in the accompanying drawings. Modifications remain possible, particularly as to the construction of various elements or by substitution of technical equivalents, without thereby departing from the scope of protection of the invention.

I claim:

1. Connection device comprising two insulating casings adapted to be installed through partitions, a first said casing being mounted on a movable said partition, and a second said casing being mounted on a fixed said partition, the first casing having at least one conductive pin and the second casing having at least one contact receptacle of a shape corresponding to that of the conductive pin, said conductive pin and said contact receptacle being mounted on said partitions only for limited elastically opposed pivotal movement relative to said partitions so as to provide automatic alignment of the casings and continuous guidance of the contact of the conductive pin in the receptacle over all the length of the receptacle, wherein the conductive pin has in transverse cross section notches spaced uniformly about its periphery and, on its free end, a rounded or conical end, and wherein the contact receptacle is constituted by contact fingers extending concentrically about the axis of penetration of the pin and of a number equal to that of the notches of said pin and disposed in said notches in service position.

2. Device according to claim 1, wherein the casings are provided with at least two opposed elastically deformable clips for application against internal surfaces of the movable element and of the fixed element and with resilient fingers disposed in opposition to the clips and having a spring function for locking the casings in service position.

3. Device according to claim 1, wherein the conductive pin is fixed in the movable partition.

4. Device according to claim 1, wherein the contact fingers are fixed in the body of the second casing by locking in a single region of connection and are made of wires of electrically conductive spring material.

5. Device according to claim 1, wherein the contact fingers each have a crooked shape.

6. Device according to claim 1, wherein the contact fingers each have several undulations.

7. Device according to claim 1, wherein one said casing comprises at least two said pins and the other said casing comprises at least two said receptacles.

8. Device according to claim 1, wherein the contact receptacle is provided, on the side opposite the second casing, with an entry cone narrowing toward the contact fingers.

9. Device according to claim 8, wherein the entry cone has a cross section less than that defined by the ends of the fingers forming the receptacle at the level of the cone.

10. Device according to claim 8, wherein the second casing for reception of the contact receptacle is provided, between the entry cone and the end of the contact fingers, with a sealing ring having an internal cross section corresponding to that of the corresponding pin and formed from a flexible plastic material.

11. Connection device comprising two insulating casings adapted to be installed through partitions, a first said casing being mounted on a movable said partition, and a second said casing being mounted on a fixed said partition, the first casing having at least one conductive pin and the second casing having at least one contact receptacle of a shape corresponding to that of the conductive pin, said conductive pin and said contact receptacle being mounted on said partitions only for limited elastically opposed pivotal movement relative to said partitions so as to provide automatic alignment of the casings and continuous guidance of the contact of the conductive pin in the receptacle over all the length of the receptacle, wherein the conductive pin has a substantially flat cross section with longitudinal notches alternating from one surface to the other and coacting with contact fingers extending in alternately offset relationship into parallel planes, at a mutual distance, from one plane to the other, equal to the thickness of the pin.

* * * * *